US009140171B2

(12) United States Patent
Schmitt et al.

(10) Patent No.: US 9,140,171 B2
(45) Date of Patent: Sep. 22, 2015

(54) FLANGE COMPONENT PART AND PRODUCTION METHOD

(75) Inventors: Markus Schmitt, Merchweiler (DE); Michael Schmidt, Friedrichsthal (DE)

(73) Assignee: Eberspächer Exhaust Technology GMBH & CO. KG, Neunkirchen (DE)

( * ) Notice: Subject to any disclaimer, the term of this patent is extended or adjusted under 35 U.S.C. 154(b) by 792 days.

(21) Appl. No.: 13/347,149

(22) Filed: Jan. 10, 2012

(65) Prior Publication Data

US 2012/0174560 A1 Jul. 12, 2012

(30) Foreign Application Priority Data

Jan. 11, 2011 (DE) ..... 10 2011 002 492

(51) Int. Cl.
*F01N 1/00* (2006.01)
*F01N 13/08* (2010.01)
*F01N 13/18* (2010.01)

(52) U.S. Cl.
CPC ..... *F01N 13/08* (2013.01); *F01N 13/1805* (2013.01); *F01N 13/1872* (2013.01)

(58) Field of Classification Search
CPC .. F01N 13/08; F01N 13/1872; F01N 13/1805
USPC ..... 60/272; 285/405; 72/370.11
See application file for complete search history.

(56) References Cited

U.S. PATENT DOCUMENTS

| | | | | |
|---|---|---|---|---|
| 3,179,449 | A | 4/1965 | Markisen | |
| 5,887,426 | A * | 3/1999 | Bruck | 60/300 |
| 6,312,022 | B1 * | 11/2001 | Brophy et al. | 285/268 |
| 2004/0135366 | A1 | 7/2004 | Sasada et al. | |
| 2005/0271562 | A1 * | 12/2005 | Biel et al. | 422/179 |
| 2007/0217941 | A1 * | 9/2007 | Hayashi et al. | 420/38 |
| 2010/0143210 | A1 * | 6/2010 | Kim | 422/177 |

FOREIGN PATENT DOCUMENTS

| | | | |
|---|---|---|---|
| DE | 29 615 840 | U1 | 10/1996 |
| DE | 199 60 619 | A1 | 7/2001 |
| DE | 10 2006 050 052 | B4 | 4/2008 |
| DE | 20 2007 012642 | U1 | 6/2008 |
| DE | 20 2008 006 653 | U1 | 1/2009 |
| EP | 0 849 445 | A1 | 6/1998 |
| FR | 2 449 840 | A1 | 9/1980 |
| WO | 01/73274 | A2 | 10/2001 |

OTHER PUBLICATIONS

English translation of French Patent Application Publication FR 2449840.*

* cited by examiner

*Primary Examiner* — Thomas Denion
*Assistant Examiner* — Jason Shanske
(74) *Attorney, Agent, or Firm* — McGlew and Tuttle, PC

(57) ABSTRACT

A flange component part (1) for a component of an exhaust gas system for an internal combustion engine, in particular of a vehicle, has a flange (2), which extends in a flange plane (4) and has a pipe section (3), which projects away from the flange (2) at a longitudinal center axis (5), which is perpendicular to the flange plane (4). A cost-efficient producibility results when the flange component (1) is a sheet metal mold, which is produced from a single metal sheet (6) by means of metal forming.

17 Claims, 4 Drawing Sheets

FLANGE COMPONENT PART AND PRODUCTION METHOD

CROSS REFERENCE TO RELATED APPLICATIONS

This application claims the benefit of priority under 35 U.S.C. §119 of German Patent Application DE 10 2011 002492.1 filed Jan. 11, 2011, the entire contents of which are incorporated herein by reference.

FIELD OF THE INVENTION

The instant invention relates to a flange component part for a component of an exhaust gas system for an internal combustion engine, in particular of a vehicle. The instant invention furthermore relates to an exhaust gas treatment device, which is equipped with at least one such flange component part, as well as to an exhaust gas system, which is equipped with at least one such flange component part.

BACKGROUND OF THE INVENTION

It happens occasionally in exhaust gas systems of internal combustion engines that individual components, such as exhaust pipes and housings of exhaust gas treatment devices, for example, such as catalysts, particle filters and sound absorbers, for example, must be fastened to one another. On principle, flanges can be used for this purpose.

In the event that a flow guiding function is to be assigned to the flange, it is possible, in principle, to attach a pipe section to the flange, which projects away from the flange at a longitudinal center axis, which is perpendicular to a flange plane. Such a pipe section can be welded to the flange, for example. The pipe section can serve as an inner wall for realizing an air gap insulation and/or as a feeding hopper or a discharge hopper, for example.

To weld the pipe section to the flange in a sufficiently reliable manner, a comparatively high wall thickness is required. So that the flange furthermore does not warp excessively in response to the welding of the pipe section, the flange must also have a comparatively large wall thickness. As a whole, the flange component part formed from flange and pipe section becomes comparatively expensive.

SUMMARY OF THE INVENTION

The instant invention deals with the problem of specifying an improved embodiment for such a flange component part or for an exhaust gas treatment device, which is equipped with it, respectively, or for an exhaust gas system equipped with it, respectively, or for a production method, which is suitable for this purpose, respectively, which is characterized in particular in that the flange component part can be produced in a comparatively cost-efficient manner.

According to the invention, a flange component part is provided for a component of an exhaust gas system for an internal combustion engine. The flange component part comprises a flange which extends in a flange plane and a pipe section which projects away from the flange in a direction of a longitudinal center axis, which is perpendicular to the flange plane. The flange component part is a single piece sheet metal mold with the flange and pipe section produced from a single metal sheet by means of metal forming. The pipe section advantageously comprises a closed revolving annular step, which projects inward, at an axial distance to the flange and the pipe section comprises a pipe section collar, which projects away from the annular step in the direction of the longitudinal center axis on a side facing away from the flange.

The invention further provides a method for producing the flange component part for a component of an exhaust gas system for an internal combustion engine as well as an exhaust gas treatment device for an exhaust gas system for an internal combustion engine of a vehicle wherein the exhaust gas treatment device includes the flange component part.

The invention is based on the general idea to produce the flange component part with the flange and the pipe section from a single metal sheet by means of metal forming. The flange component part, which is thus designed as a one-piece or single-piece, integral sheet metal mold, can be produced in a particularly simple manner by means of metal forming technology. In particular, deep-drawing methods are suitable for forming the flange component part. Such metal forming methods can be realized in a comparatively cost-efficient manner. Simultaneously, it is now possible to provide for a comparatively small wall thicknesses for the flange and for the pipe section, whereby the flange component part can be produced to be lighter and can be produced in a more cost-efficient manner. As a whole, the result is an enormous cost advantage for the light flange component part, which is produced by metal forming, as compared to a common, constructed, heavy flange component part.

According to an advantageous embodiment, the flange can comprise an annular area, which encloses the pipe section so as to be closed in a ring-shaped manner. In particular, the annular area can be designed in the shape of a circular ring, for example when the pipe section has a circular cross section. For this purpose, the flange can reinforce the pipe section at the transition to the flange.

The flange can comprise a plurality of fastening areas, which are arranged so as to be distributed in peripheral direction and so as to project radially outward, by means of which the flange component part can be fastened to a counter flange, which is complementary to the flange. Due to the fact that the flange projects radially outward in this manner only in the area of the junctions to the counter flange, it incidentally constructs in a comparatively compact, light and accordingly cost-efficient manner. The fastening areas can in each case comprise at least one fastening opening, through which a screw connection can be realized, for example. The fastening areas can project outward in particular from the annular area, advantageously in radial direction.

In the case of another embodiment, the flange can comprise a radially outward flange collar, which projects away from the flange on the same side as the pipe section. With the help of such a flange collar, the flange, in particular the annular area, can be reinforced intensively. This is the case especially when, according to one option, the flange collar revolves so as to be closed in peripheral direction.

In the case of another embodiment, the pipe section can comprise a closed, revolving annular step, which projects inward, at an axial distance to the flange. The pipe section can also be stabilized or reinforced, respectively, distally to the flange with the help of such an annular step.

According to a special further development, the pipe section can comprise a pipe section collar, which projects away from the annular step on a side facing away from the flange, wherein this pipe section collar also has a longitudinal center axis, which is perpendicular to the flange plane. In particular the longitudinal center axes of the pipe section collar and of the pipe section thus coincide, so that pipe section and pipe section collar are arranged coaxially. Due to the fact that the pipe section collar projects in an axial direction away from the annular step, which projects inward, in particular radially, the pipe section collar has a smaller inner cross section than the remaining pipe section between annular step and flange. The pipe section can be embodied cylindrically or conically, at least between flange and annular step. The pipe section collar can also be embodied cylindrically or conically. The cross section of the pipe section and/or of the pipe section collar can thereby be configured to be circular or elliptical or oval.

By means of a conical pipe section and/or a conical pipe section collar, a funnel shape for the pipe piece can be realized in particular. Such a funnel configuration also results for the case when the pipe section and the pipe section collar are configured so as to be substantially cylindrical. Provided that the flange component part is produced by means of deep-drawing, the pipe section as well as the pipe section collar, which is available, if necessary, inevitable has a certain tapering, so as to facilitate the final forming of the metal formed flange component part by the respective deep-drawing tool.

A production method according to the invention is characterized in that a pot, which comprises a flat pot bottom on the one axial end and a flat pot edge, which projects radially outward, on the other axial end, is molded from a flat blank made of metal sheet by means of deep-drawing, wherein the pot bottom and the pot edge are connected to one another by means of a pot wall, which forms a pipe body. Based on this intermediate product, namely the pot, the flange component part presented herein can now be produced in a particularly simple manner.

For example, an interior pot area can be cut out of the pot bottom, for example by means of a punching process, and an exterior edge area can but cut off from the pot edge, for example by means of a punching process. A pot bottom remainder, which projects radially inward, as well as a pot edge remainder, which projects radially outward, remains of the pot after this separating step. On principle, this separating process can be linked to a further metal forming process.

In a further step, a flange, which extends in a flange plane, can be molded from the pot edge remainder by means of deep-drawing. In contrast, an axial end section of the pipe body can be molded from the pot bottom remainder by means of deep-drawing. In particular, the afore-mentioned annular step and the pipe section collar can be formed from the mold at the axial end section of the pipe body in response to the deep-drawing of the axial end section.

An exhaust gas treatment device according to the invention is characterized by a housing for accommodating at least one exhaust gas treatment element from the group particle filter, catalyst and sound absorber. At least one connection, through which exhaust gas can enter into the housing (inlet connection), or through which exhaust gas can escape from the housing (outlet connection) is embodied at this housing. A flange component part of the above-described type is provided at the respective connection. The respective connection can thereby comprise the respective flange component part. It is also possible to form the respective connection by means of the respective flange component part.

An exhaust gas system according to the invention comprises at least one exhaust gas treatment device of the aforementioned type.

Further important features and advantages of the invention follow from the claims, from the drawings and from the corresponding figure description by means of the drawings. It goes without saying that the features mentioned above and the features, which will still be explained below, cannot only be used in the respectively specified combination, but also in other combinations or alone, without leaving the context of the instant invention.

Preferred exemplary embodiments of the invention are illustrated in the drawings and will be defined in more detail in the following description, wherein the same reference numerals refer to the same component parts or to similar or functionally equal components parts. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
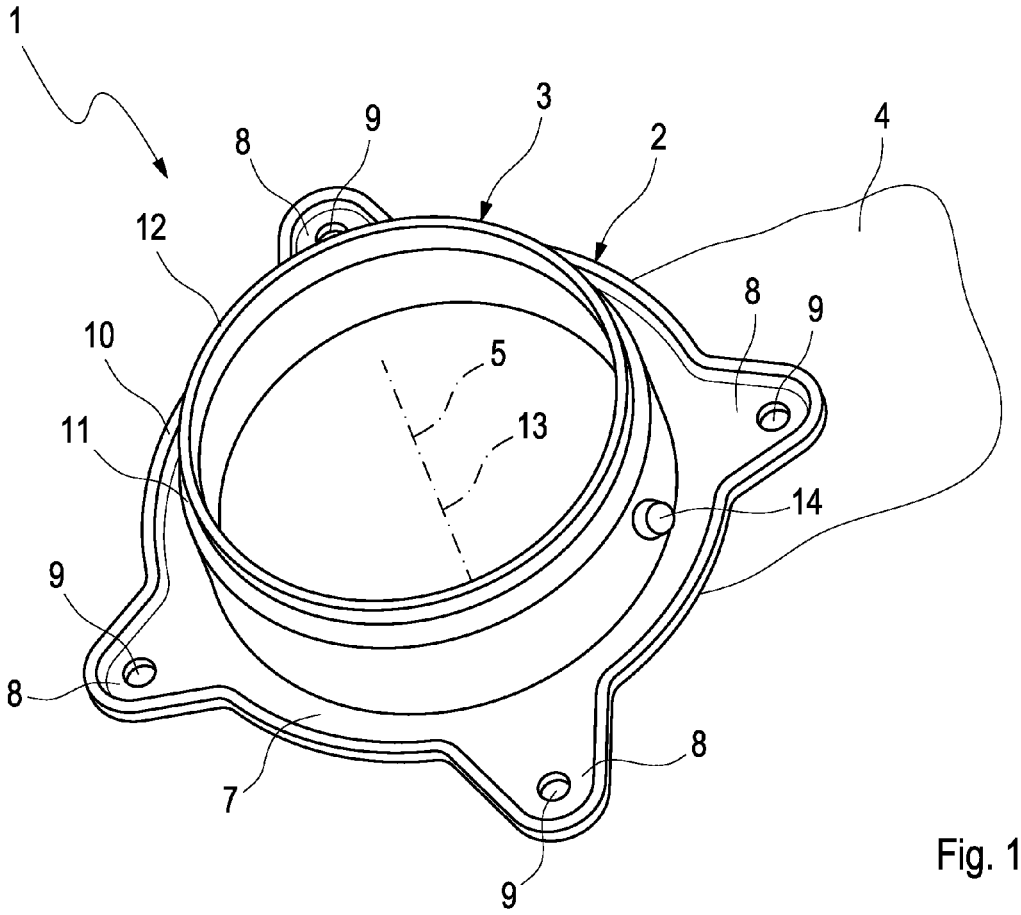
FIG. 1 is an isometric view of a flange component part.

Referring to the drawings in particular, according to FIG. 1, a flange component part 1 comprises a flange 2 and a pipe section 3. The flange component part 1 can be used for a component of an exhaust gas system, for example at an inlet connection or at an outlet connection. In the case of an internal combustion engine, which can be arranged in particular in a vehicle, the exhaust gas system serves to discharge combustion exhaust gases.

The flange 2 extends in a flange plane 4. The pipe section 3 has a longitudinal center axis 5, which is perpendicular to the flange plane 4. Accordingly, the pipe section 3 projects away from the flange 2 on one side of the flange plane 4.

Figure 2:
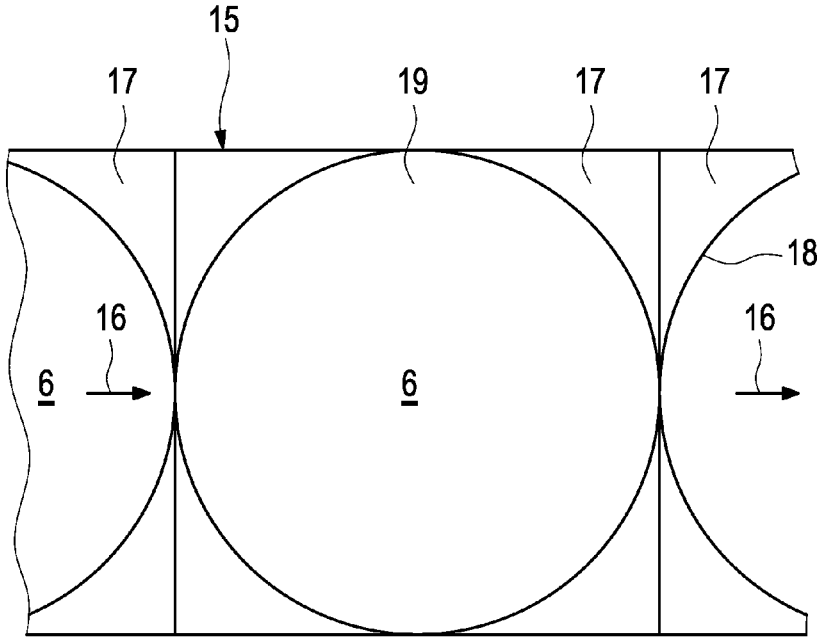
FIG. 2 is a top view of a sheet metal web for producing the flange component parts.

The flange component part 1 presented herein is designed as an integral sheet metal mold, which is produced from a single metal sheet 6, which is shown in FIG. 2 in the unprocessed state, by means of metal forming.

According to FIG. 1, the flange 2 comprises an annular area 7, which encloses the pipe section 3 so as to be closed in a ring-shaped manner. In the example, the annular area 7 is designed in the shape of a circular ring. The flange 2 furthermore comprises a plurality of fastening areas 8, which are arranged so as to be distributed in peripheral direction. The fastening areas 8 are also located in the flange plan 4 and project radially outward away from the annular area 7. With the help of these fastening areas 8, the flange component part 1 can be fastened to a counter flange, which is not shown herein, which is complementary to the flange 2. For example, the respective fastening area 8 can include a fastening opening 9, through which a screw connection of the flange 2 to said counter flange can be realized, for example.

Without limiting the universality, exactly four fastening areas 8 are embodied on the flange 2 in the illustrated example.

The flange 2 furthermore comprises a flange collar 10, which is molded radially outward on the flange 2 and which projects away from the flange 2 on the same side as the pipe section 3. Advantageously, the flange collar 10 revolves so as to be closed in peripheral direction. In the example, the flange collar 10 is arranged radially outside along the annular area 7, so as to enclose the fastening areas 8. In particular, the flange collar 10 is formed by an outer edge of the flange 2, which is angled away from the flange plane 4.

The pipe section 3 connects to the radially interior end of the annular area 7 and has an annular step 11 at an axial distance to the flange 2, thus distally to the flange 2, which revolves so as to be closed in peripheral direction and which furthermore projects inward. The annular step 11 is thereby arranged coaxially to the longitudinal center axis 5. A pipe section collar 12 connects to the remaining pipe section 3 at this annular step 11. The pipe section collar 12 thereby forms a component part of the pipe section 3, namely the axial end of the pipe section 3, which is distal relative to the flange 2. This pipe section collar 12 thereby projects axially away from the annular step 11 on a side facing away from the flange 2. Advantageously, a longitudinal center axis 13 of the pipe section collar 12 coincides with the longitudinal center axis 5 of the remaining pipe section 3. The pipe section collar 12 thus extends coaxially to the pipe section 3. Consequently, the longitudinal center axis 13 of the pipe section collar 12 is thus also perpendicular to the flange plane 4.

The pipe section 3 is embodied so as to be cylindrical or slightly conical. The pipe section collar 12, in turn, can be designed so as to be cylindrical or slightly conical. In the example, pipe section 3 and pipe section collar 12 in each case have circular cross sections.

A dome, via which a sensor can be connected to the flange component part 1, can be molded on the flange component part 1 on the pipe section 3 in an area 14. This dome can also be integrally molded on the flange component part 1 by means of metal forming technology, for example.

A method for producing the flange component part 1, which is presented herein, will be explained below in more detail by means of FIGS. 2-8.

FIG. 2 shows a sheet metal web 15, which is supplied to a metal forming tool in a feed direction 16 or which is guided through a metal forming tool, respectively. Rectangular or square web sections 17 follow one another continuously in this sheet metal web 15. These web sections 17 are dimensioned such that a circular metal sheet 6 can in each case be punched from it. After the punching of the metal sheet 6, a complementary circular opening 18 remains in the web section 17. The sheet metal 6 forms a blank 19, which is flat in the initial state.

Figure 3:
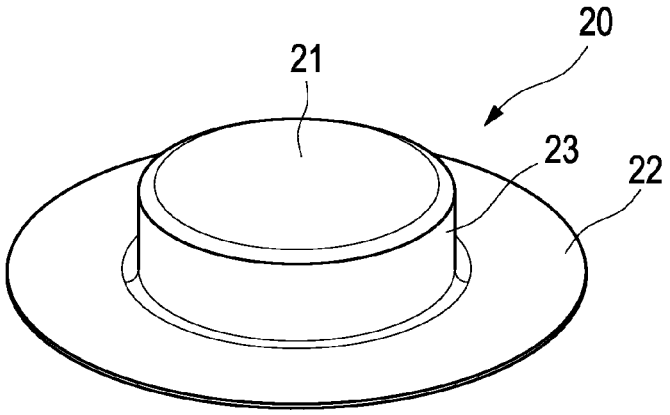
FIG. 3 is an isometric view of the flange component part during a production process in response to one of different production states.

According to FIG. 3, a pot 20 is formed from the flat blank 19 by means of deep-drawing. The pot 20 has a flat pot bottom 21 on the one axial end and a flat pot edge 22, which projects radially outward, on the other axial end. Pot bottom 21 and pot edge 22 are connected to one another by means of an annular or sleeve-shaped pot wall 23, which already forms a basic shape of the pipe body 3.

Figure 4:
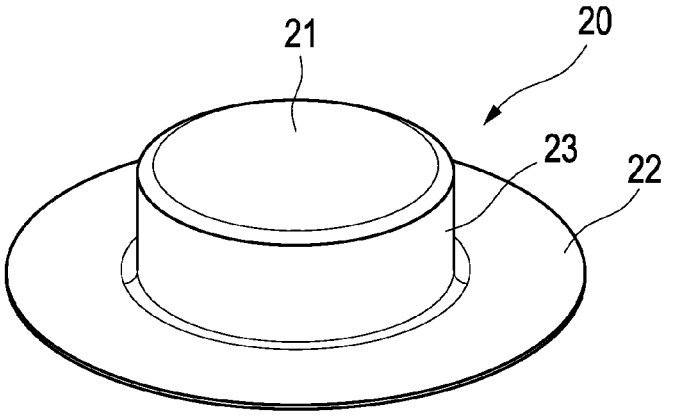
FIG. 4 is an isometric view of the flange component part during the production process in response to another of different production states.

According to FIG. 4, the deep-drawing of the pot 20 can take place in several stages. For example, FIG. 3 shows the result of a preliminary stage, while FIG. 4 shows the result of an end stage, which can also be identified as reshaping stage. In the case of the pot 20 according to FIG. 4, the pot wall 23 can be identified as being extended in axial direction.

Figure 5:
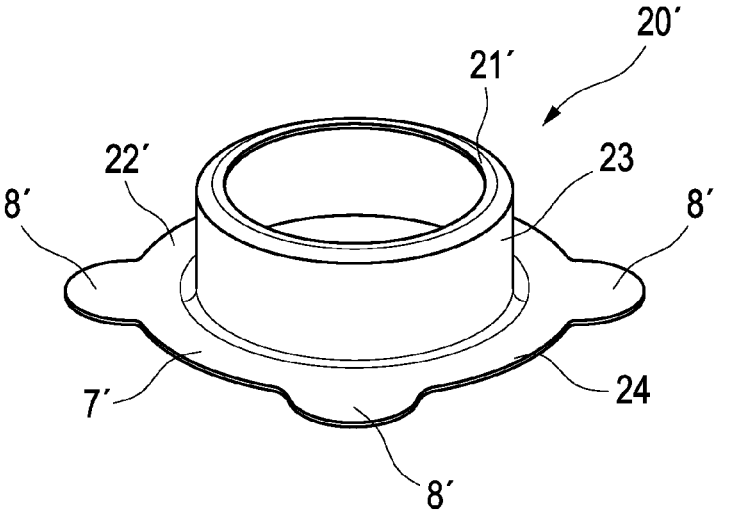
FIG. 5 is an isometric view of the flange component part during the production process in response to another of different production states.

To get from the state according to FIG. 3 or from the state according to FIG. 4 to the state according to FIG. 5, an interior pot area is cut out of the pot bottom 21 on the one hand, so that a pot bottom remainder 21', which projects radially inward, remains on the pot wall 23. On the other hand, an exterior edge area is cut off from the pot edge 22, so that only a pot edge remainder 22', which projects radially outward from the pot wall 23, remains. Accordingly, FIG. 5 shows a modified pot 20', which is already slightly reminiscent of the flange component part 1. Blanks for the annular area 7 can already be seen at the pot edge remainder 22' and the fastening areas 8, which are identified in FIG. 5 with 7' or 8', respectively, are molded.

Figure 6:
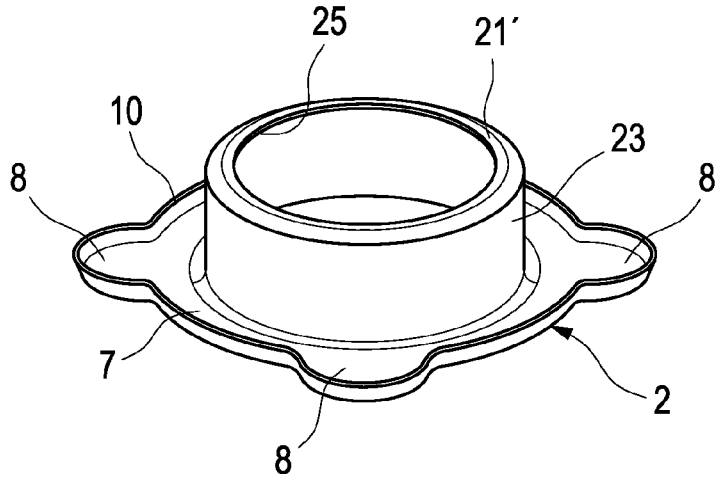
FIG. 6 is an isometric view of the flange component part during the production process in response to another of different production states.

In the transition to the state according to FIG. 6, the flange collar 10 is molded at an outer edge 24 of the pot edge remainder 22', which can still be seen in FIG. 5. The annular area 7 and the fastening areas 8 are thereby created simultaneously. Except for the fastening openings 9, the flange 2 is then finished.

Figure 7:
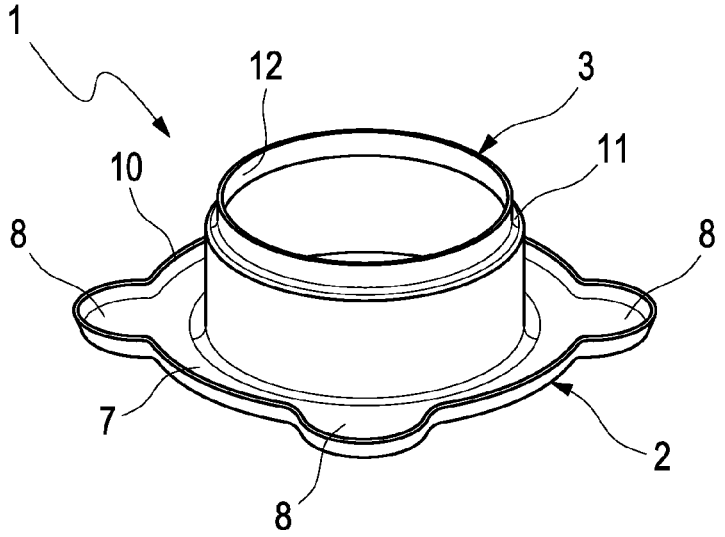
FIG. 7 is an isometric view of the flange component part during the production process in response to another of different production states.

In the transition to the state according to FIG. 7, an inner edge 25 of the pot bottom remainder 21' from FIG. 6 is now shaped axially on a side facing away from the flange 2, whereby, according to FIG. 7, the annular step 11 on the one hand and the pipe section collar 12 on the other hand are molded. Through this, the pipe section 3 is then also finished. The molding of the flange collar 10 and of the pipe section collar 12 can also take place in reverse order or simultaneously.

Figure 8:
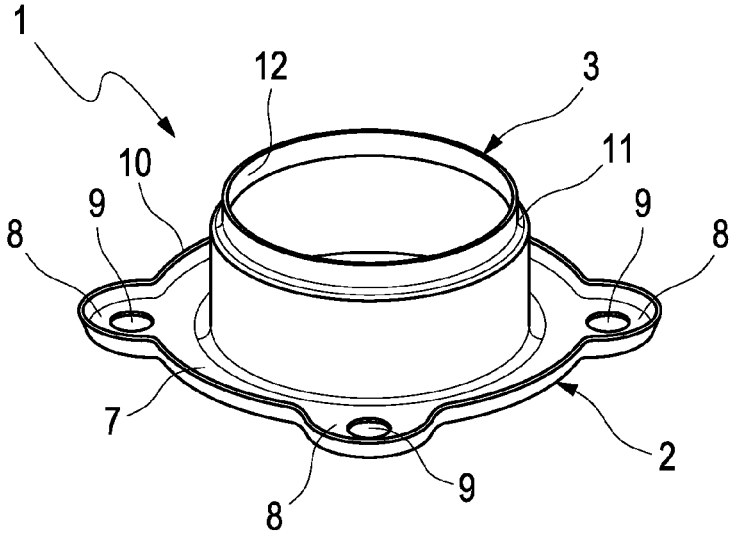
FIG. 8 is an isometric view of the flange component part during the production process in response to another of different production states.

The fastening openings 9 are now subsequently produced according to FIG. 8, whereby the flange 2 and thus also the flange component part 1 are finished. The production of the fastening openings 9 can also take place simultaneously with the molding of the flange collar 10 and/or of the pipe section collar 12.

Figure 9:
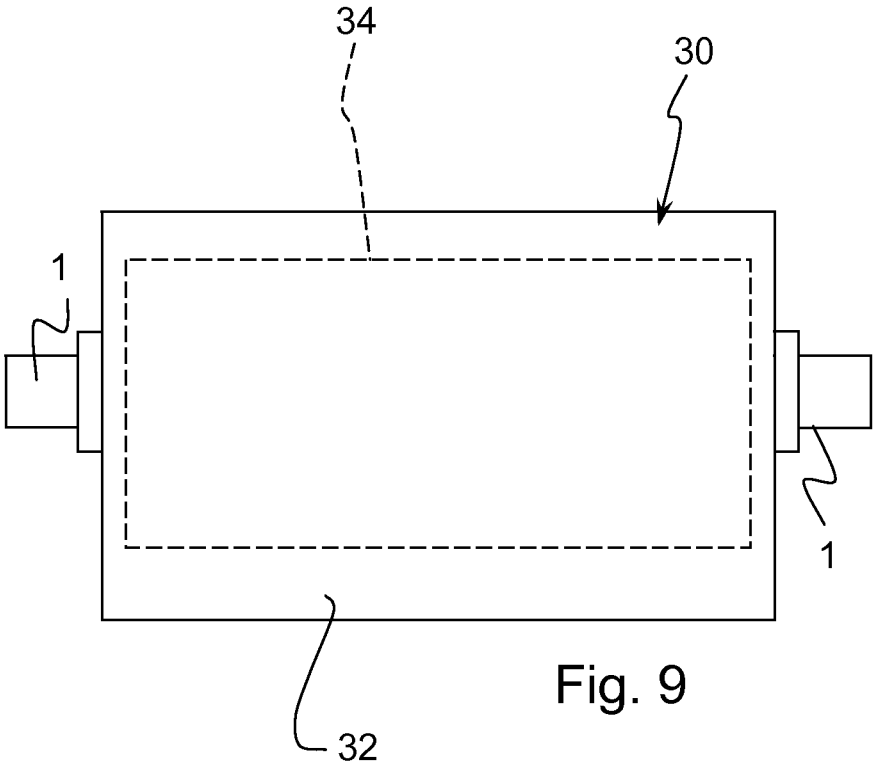
FIG. 9 is a schematic view of an exhaust gas treatment device for an exhaust gas system for an internal combustion engine.

FIG. 9 shows an exhaust gas treatment device 30 for an exhaust gas system for an internal combustion engine, in particular of a vehicle. The exhaust gas treatment device 30 comprises a housing 32 for accommodating at least one exhaust gas treatment element 34 that is one or more of a particle filter, a catalyst and a sound absorber. At least one inlet connection is embodied at the housing, through which exhaust gas can enter into the housing. At least one outlet connection is embodied at the housing, through which exhaust gas can escape from the housing. At least one of the inlet connection and the outlet connection comprises the flange component part 1.

While specific embodiments of the invention have been shown and described in detail to illustrate the application of the principles of the invention, it will be understood that the invention may be embodied otherwise without departing from such principles.

What is claimed is:

1. A flange component part for a component of an exhaust gas system for an internal combustion engine, the flange component part comprising:

a flange which extends in a flange plane; and a pipe section which projects away from said flange in a direction of a longitudinal center axis, which direction is perpendicular to the flange plane, the pipe section comprising:

a cylindrical or conical flange side pipe section portion projecting from the flange, in the direction of the longitudinal center axis, to a step end of the flange side pipe section portion;

an annular step, which projects radially inwardly from the step end of the flange side pipe section portion, at an axial distance to the flange, to a collar end of the annular step, spaced radially inwardly from the step end of the flange side pipe section portion; and a cylindrical or conical pipe section collar, which projects away from the collar end of the annular step in the direction of the longitudinal center axis on a side facing away from the flange, wherein the flange component part is a single piece sheet metal mold with said flange and pipe section produced from a single metal sheet by means of metal forming, wherein the pipe section includes an area with a dome that is integrally molded with the flange component part by means of metal forming.

2. The flange component part according to claim 1, wherein that the flange comprises an annular area, which encloses the pipe section so as to be closed in a ring-shaped manner.

3. The flange component part according to claim 1, wherein that the flange comprises a plurality of fastening areas, which are arranged so as to be distributed in peripheral direction and so as to project radially outward, by means of which the flange component part can be fastened to a counter flange, which is complementary to the flange.

4. The flange component part according to claim 2, wherein that the flange comprises a plurality of fastening areas, which are arranged so as to be distributed in peripheral direction and so as to project radially outward, by means of which the flange component part can be fastened to a counter flange, which is complementary to the flange.

5. The flange component part according to claim 1, wherein that the flange comprises a radially outward flange collar, which projects away from the flange on the same side as the pipe section.

6. The flange component part according to claim 1, wherein:

the pipe section is formed by molding a pot from a flat blank made of the single metal sheet by means of deep-drawing, which pot comprises a pot wall with a pot bottom on one axial end and a pot edge, which projects radially outward from the sidewall on the other axial end, said pot wall forming the pipe body;

an interior pot area is cut out of the pot bottom and an exterior edge area is cut off from the pot edge, so that a pot bottom remainder, which projects radially inward, as well as a pot edge remainder, which projects radially outward, remain;

the flange, which extends in the flange plane, is formed from the pot edge remainder, which projects radially outwardly, by means of deep-drawing; and an axial end section of the pipe body is formed from the pot bottom remainder , which projects radially inwardly, by means of deep-drawing.

7. A method for producing a flange component part for a component of an exhaust gas system for an internal combustion engine, the method comprising the steps of:

providing a flange which extends in a flange plane;

providing a pipe section which projects away from said flange in a direction of a longitudinal center axis, which direction is perpendicular to the flange plane, the pipe section comprising a cylindrical or conical flange side pipe section portion projecting, in the direction of the longitudinal center axis, from the flange to a step end of the flange side pipe section portion; an annular step, which projects radially inwardly from the step end of the flange side pipe section portion, at an axial distance to the flange, to a collar end spaced radially inwardly from the step end of the flange side pipe section portion; and a cylindrical or conical pipe section collar, which projects away from the collar end of the annular step in the direction of the longitudinal center axis on a side facing away from the flange; and forming the flange component part as a single piece sheet metal mold with said flange and pipe section produced from a single metal sheet by means of metal forming, wherein:

said step of providing the pipe section comprises the steps of:

molding a pot from a flat blank made of the single metal sheet by means of deep-drawing, which pot comprises a pot wall with a pot bottom on one axial end and a pot edge, which projects radially outward from the sidewall on the other axial end, said pot wall forming the pipe body;

cutting an interior pot area out of the pot bottom;

cutting an exterior edge area off from the pot edge, so that a pot bottom remainder, which projects radially inwardly, as well as a pot edge remainder, which projects radially outwardly, remain; and deep-drawing the pot bottom remainder, which projects radially inwardly, to form an axial end section of the pipe body including the pipe section collar; and the step of providing the flange, which extends in the flange plane, comprises deep-drawing the pot edge remainder, which projects radially outwardly.

8. The method according to claim 7, wherein that the flange comprises an annular area, which encloses the pipe section so as to be closed in a ring-shaped manner.

9. The method according to claim 7, wherein that the flange comprises a plurality of fastening areas, which are arranged so as to be distributed in peripheral direction and so as to project radially outward, by means of which the flange component part can be fastened to a counter flange, which is complementary to the flange.

10. The method according to claim 8, wherein that the flange comprises a plurality of fastening areas, which are arranged so as to be distributed in peripheral direction and so as to project radially outward, by means of which the flange component part can be fastened to a counter flange, which is complementary to the flange.

11. The method according to claim 7, wherein that the flange comprises a radially outward flange collar, which projects away from the flange on the same side as the pipe section.

12. An exhaust gas treatment device for an exhaust gas system for an internal combustion engine of a vehicle, the device comprising:

a housing for accommodating at least one exhaust gas treatment element from the group comprising a particle filter, a catalyst and a sound absorber;

an inlet connection embodied at the housing, through which exhaust gas can enter into the housing; and an outlet connection embodied at the housing, through which exhaust gas can escape from the housing, wherein at least one of said inlet connection and said outlet connection comprises a flange component part comprising:

a flange which extends in a flange plane; and a pipe section which projects away from said flange in a direction of a longitudinal center axis, which direction is perpendicular to the flange plane, the pipe section comprising a cylindrical or conical flange side pipe section portion projecting, in the direction of the longitudinal center axis, from the flange to a step end of the flange side pipe section portion; an annular step, which projects radially inwardly from the step end of the flange side pipe section portion, at an axial distance to the flange, to a collar end spaced radially inwardly from the step end of the flange side pipe section portion; and a cylindrical or conical pipe section collar, which projects away from the collar end of the annular step in the direction of the longitudinal center axis on a side facing away from the flange wherein the flange component part is a single piece sheet metal mold with said flange and pipe section produced from a single metal sheet by means of metal forming, the flange being connected to the housing at one of the inlet connection and the outlet connection with the flange plane disposed parallel to an outer surface of the housing, wherein the pipe section includes an area with a dome that is integrally molded with the flange component part by means of metal forming.

13. The exhaust gas treatment device according to claim 12, wherein that the flange comprises an annular area, which encloses the pipe section so as to be closed in a ring-shaped manner.

14. The exhaust gas treatment device according to claim 12, wherein that the flange comprises a plurality of fastening areas, which are arranged so as to be distributed in peripheral direction and so as to project radially outward, by means of which the flange component part can be fastened to a counter flange, which is complementary to the flange.

15. The exhaust gas treatment device according to claim 12, wherein that the flange comprises a radially outward flange collar, which projects away from the flange on the same side as the pipe section.

16. The exhaust gas treatment device according to claim 12, wherein:

the pipe section is formed by molding a pot from a flat blank made of the single metal sheet by means of deep-drawing, which pot comprises a pot wall with a pot bottom on one axial end and a pot edge, which projects radially outward from the sidewall on the other axial end, said pot wall forming the pipe body;

an interior pot area is cut out of the pot bottom and an exterior edge area is cut off from the pot edge, so that a pot bottom remainder, which projects radially inward, as well as a pot edge remainder, which projects radially outward, remain;

the flange, which extends in the flange plane, is formed from the pot edge remainder, which projects radially outwardly, by means of deep-drawing; and an axial end section of the pipe body is formed from the pot bottom remainder, which projects radially inwardly, by means of deep-drawing.

17. A method for producing a flange component part for a component of an exhaust gas system for an internal combustion engine, the method comprising the steps of:

providing a flange which extends in a flange plane;

providing a pipe section which projects away from said flange in a direction of a longitudinal center axis, which direction is perpendicular to the flange plane, the pipe section comprising a cylindrical or conical flange side pipe section portion projecting, in the direction of the longitudinal center axis, from the flange to a step end of the flange side pipe section portion; an annular step, which projects radially inwardly from the step end of the flange side pipe section portion, at an axial distance to the flange, to a collar end spaced radially inwardly from the step end of the flange side pipe section portion; and a cylindrical or conical pipe section collar, which projects away from the collar end of the annular step in the direction of the longitudinal center axis on a side facing away from the flange; and forming the flange component part as a single piece sheet metal mold with said flange and pipe section produced from a single metal sheet by means of metal forming, wherein the pipe section includes an area with a dome that is integrally molded with the flange component part by one or more metal forming steps.

* * * * *